US006082488A

United States Patent [19]

Lin

[11] Patent Number: 6,082,488

[45] Date of Patent: Jul. 4, 2000

[54] MUFFLER FOR VEHICLES

[76] Inventor: Min-Chyr Lin, 90, Pei-Hei, Shui Shang Hsiang, Chia Yi Hsien, Taiwan

[21] Appl. No.: 09/400,985

[22] Filed: Sep. 22, 1999

[51] Int. Cl.[7] ..... F01N 1/24

[52] U.S. Cl. ..... 181/256; 181/257

[58] Field of Search ..... 181/252, 256, 181/250, 257, 273, 276, 282

[56] References Cited

U.S. PATENT DOCUMENTS

| | | | |
|---|---|---|---|
| 3,710,891 | 1/1973 | Flugger | 181/252 |
| 5,350,888 | 9/1994 | Sager, Jr. et al. | 181/252 |

*Primary Examiner*—Khanh Dang
*Attorney, Agent, or Firm*—Larson & Taylor, PLC

[57] ABSTRACT

A muffler includes a first inner tube assembly including an inner tube, an outer tube, and a first glassfiber layer sandwiched between the inner tube and the outer tube. Each of the inner tube and the outer tube includes apertures through which exhaust gas is passable. The inner tube defines a primary passage for the exhaust gas. A second inner tube assembly includes a tubular member for receiving the first inner tube assembly and a second glassfiber layer enclosing the tubular member. The tubular member includes apertures through which the exhaust gas is passable. The tubular member and the outer tube of the first inner tube assembly have a space therebetween, thereby defining a secondary passage for the exhaust gas. An outer casing receives the second inner tube assembly. A brace member is attached to each end of the outer casing for securely retaining the first inner tube assembly and the second inner tube assembly in place. Each brace member includes a plurality of third apertures communicated with the primary passage and the secondary passage. An end cover is attached to each end of the outer casing for enclosure purpose. Each end cover includes a guide tube four guiding the exhaust gas in and out of the primary passage and the secondary passage of the muffler.

1 Claim, 3 Drawing Sheets

MUFFLER FOR VEHICLES

BACKGROUND OF THE INVENTION

1. Field of the Invention

The present invention relates to a muffler for vehicles with better muffling effect.

2. Description of the Related Art

FIG. 4 of the drawings illustrates a conventional muffler having a muffler body "a", an exhaust tube "b" mounted in the muffler body "a", and a glassfiber layer "c" filled between the muffler body "a" and the exhaust tube "b". The glassfiber layer "c" performs the required muffling effect, as a portion of the exhaust gas will be absorbed by the glassfiber. Yet, the muffling effect is found unsatisfactory. In addition, carbon will be accumulated in and thus block the apertures in the exhaust tube "b". Furthermore, the muffling effect is poor when the accelerator pedal is pressed rapidly, as the muffler provides only a passage for the exhaust gas. The present invention is intended to provide an improved muffler that mitigates and/or obviates the above problems.

SUMMARY OF THE INVENTION

It is a primary object of the present invention to provide a muffler for vehicles that provides better muffling effect, absorbs a large amount of instantaneously exhausted gas, and lengthens the life of the muffler.

A muffler for vehicles in accordance with the present invention comprises:

a first inner tube assembly comprising an inner tube, an outer tube, and a first glassfiber layer sandwiched between the inner tube and the outer tube, each of the inner tube and the outer tube including a plurality of first apertures through which exhaust gas is passable, the inner tube defining a primary passage for the exhaust gas;

a second inner tube assembly including a tubular member for receiving the first inner tube assembly and a second glassfiber layer enclosing the tubular member, the tubular member including a plurality of second apertures through which the exhaust gas is passable, the tubular member and the outer tube of the first inner tube assembly having a space therebetween, thereby defining a secondary passage for the exhaust gas; and an outer casing for receiving the second inner tube assembly, the outer casing including two ends, a brace member being attached to each said end of the outer casing for securely retaining the first inner tube assembly and the second inner tube assembly in place, each said brace member including a plurality of third apertures communicated with the primary passage and the secondary passage, an end cover being attached to each said end of the outer casing for enclosure purpose, each said end cover including a guide tube for guiding the exhaust gas in and out of the primary passage and the secondary passage of the muffler.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

Figure 1:
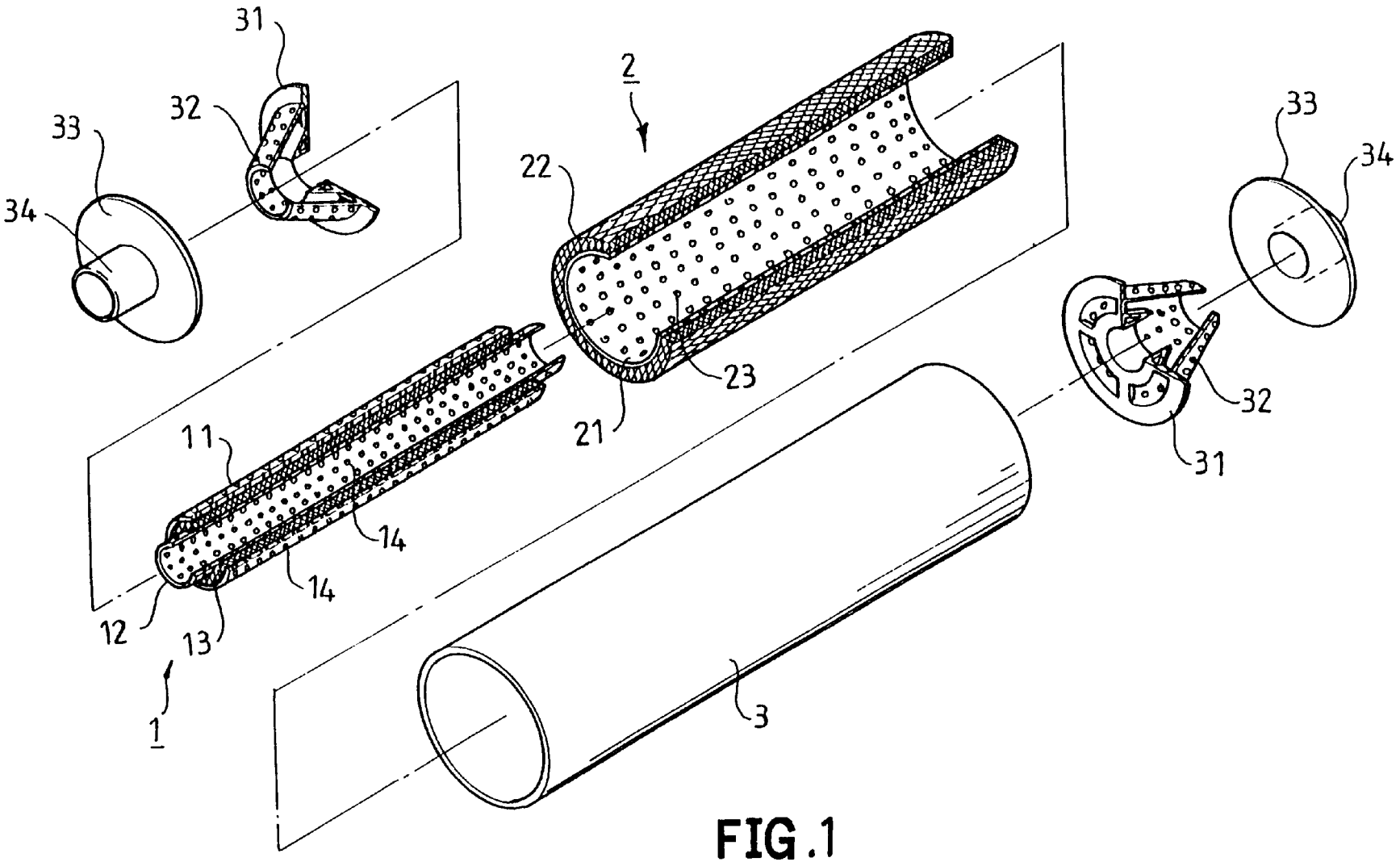
FIG. 1 is an exploded perspective view of a muffler in accordance with the present invention.
Figure 2:
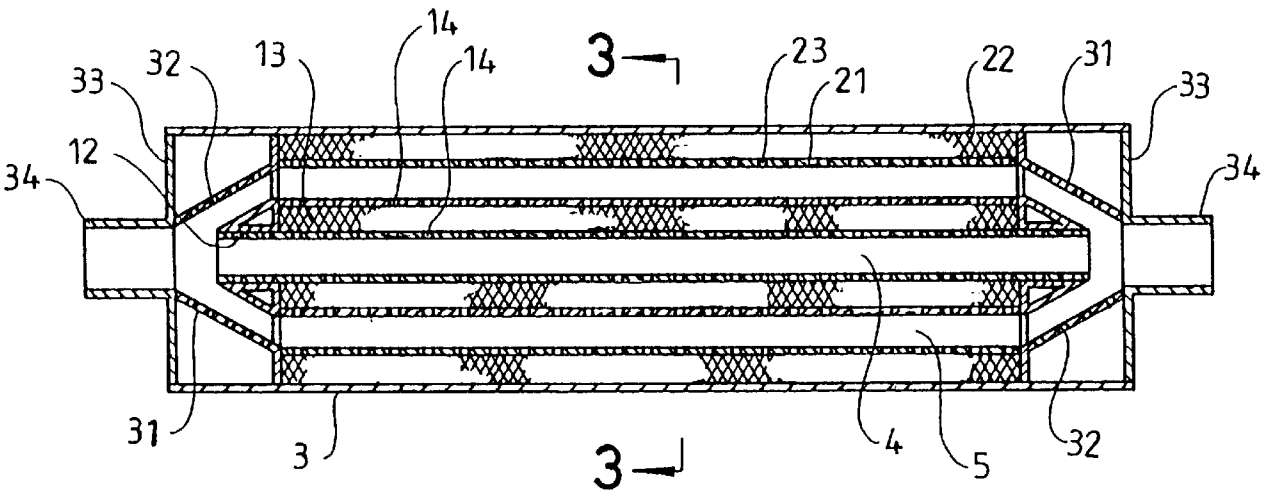
FIG. 2 is a longitudinal sectional view of the muffler in accordance with the present invention.
Figure 3:
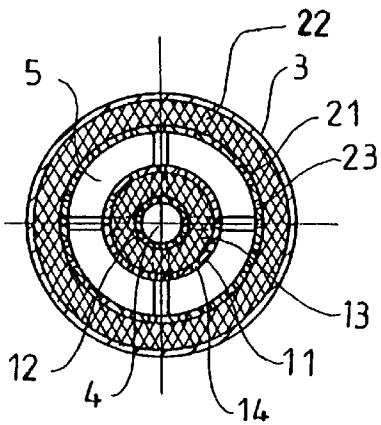
FIG. 3 is a sectional view taken along line 3—3 in FIG. 2.
Figure 4:
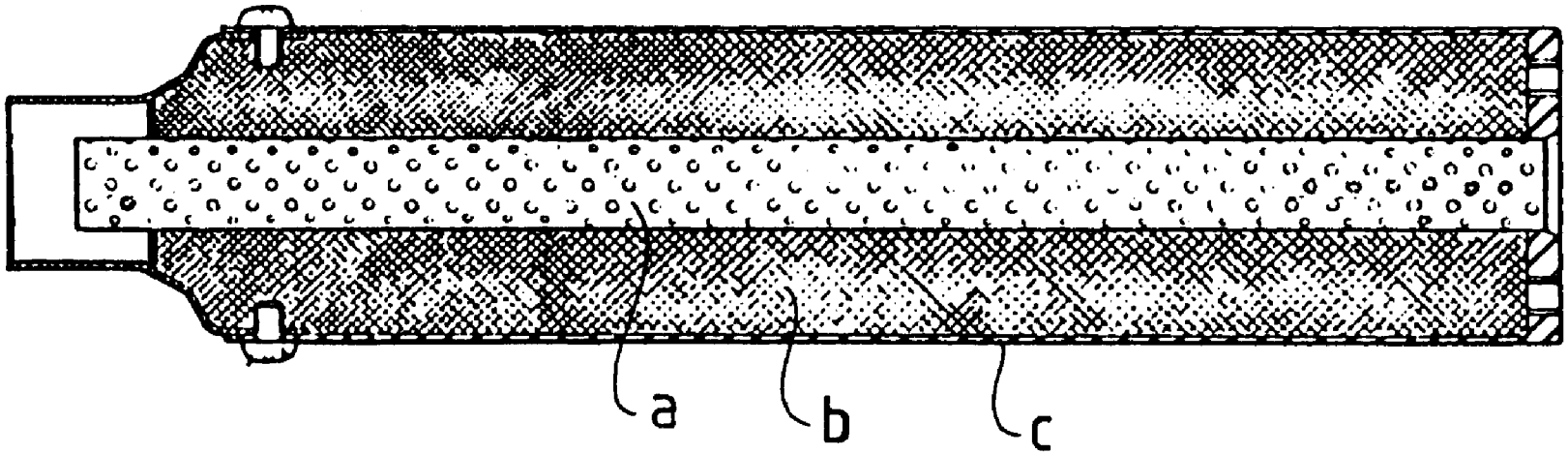
FIG. 4 PRIOR ART
FIG. 4 is a longitudinal sectional view of a conventional muffler.

Referring to FIGS. 1 through 3, a muffler in accordance with the present invention generally includes a first inner tube assembly 1, a second inner tube assembly 2, and an outer casing 3. The first inner tube assembly 1 includes an inner tube 12, an outer tube 11, and a glassfiber layer 13 sandwiched between the inner tube 12 and outer tube 11. Each of the inner tube 12 and the outer tube 11 is made of metal and includes a plurality of apertures 14 through which gas passes. The inner tube 12 defines a primary passage 4 through which exhaust gas flows.

The second inner tube assembly 2 includes a tubular member 21 and a glassfiber layer 22 enclosing the tubular member 21. The second inner tube assembly 2 is mounted inside the outer casing 3. The tubular member 21 receives the first inner tube assembly 1 and has a distance to the first inner tube assembly 1, thereby defining a secondary passage 5 for the exhaust gas. The tubular member 21 has a plurality of apertures 23 through which gas passes so as to be absorbed by the glassfiber layer.

The outer casing 3 may be a conventional outer casing for a muffler and made of metal. After mounting the first inner tube assembly 1 and the second inner tube assembly 2 into the outer casing 3, a brace member 31 is attached to (e.g., by soldering) each end of the outer casing 3 for retaining the first inner tube assembly 1 and the second inner tube assembly 2 in place in a spaced manner, best shown in FIG. 3. Each brace member 31 also has a plurality of apertures 32 communicated with the primary passage 4 and the secondary passage 5, by allowing flow for the gas. An end cover 33 is provided to (by soldering or other suitable means) enclose each end of the outer casing 3. Each end cover 33 includes a guide tube 34 through which gas passes.

Referring to FIGS. 2 and 3, the first inner tube assembly 1 and the second inner tube assembly 2 are secured in the outer casing 3, wherein the main passage 4 defined min the inner tube 12 of the first inner tube assembly 1 and the secondary passage 5 defined between the tubular member 21 and the outer tube 11 provide passages for the exhaust gas. Thus, more exhaust gas contacts with the glassfiber layers 13, 22 via more apertures 14, 23, thereby providing better muffling effect.

According to the above description, it is appreciated that the contact area between the glassfiber layers and the exhaust gas is increased and thus effectively eliminates noise as a result of flow of the exhaust gas. The exhaust gas flow can be muffled via the primary passage under normal exhaust condition. When a large amount of gas is exhausted, excessive exhaust gas enters the secondary passage to obtain the required muffling effect. In addition, the number of the apertures of the muffler is increased such that the problem of carbon accumulation in the apertures is mitigated. Thus, the life of the muffler is lengthened.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A muffler for vehicles comprising:

inner tube assembly comprising an inner tube, an outer tube, and a first glassfiber layer sandwiched between the inner tube and the outer tube, each of the inner tube and the outer tube including a plurality of first apertures through which exhaust gas is passable, the inner tube defining a primary passage for the exhaust gas;

a second inner tube assembly including a tubular member for receiving the first inner tube assembly and a second glassfiber layer enclosing the tubular member, the tubular member including a plurality of second apertures through which the exhaust gas is passable, the tubular member and the outer tube of the first inner tube assembly having a space therebetween, thereby defining a secondary passage for the exhaust gas; and an outer casing for receiving the second inner tube assembly, the outer casing including two ends, a brace member being attached to each said end of the outer casing for securely retaining the first inner tube assembly and the second inner tube assembly in place, each said brace member including a plurality of third apertures communicated with the primary passage and the secondary passage, an end cover being attached to each said end of the outer casing for enclosure purpose, each said end cover including a guide tube four guiding the exhaust gas in and out of the primary passage and the secondary passage of the muffler.

* * * * *